US010087794B2

(12) United States Patent
Jocsak et al.

(10) Patent No.: US 10,087,794 B2
(45) Date of Patent: Oct. 2, 2018

(54) OIL PAN WITH DEDICATED DRAIN FOR POSITIVE CRANKCASE VENTILATION

(71) Applicant: GM GLOBAL TECHNOLOGY OPERATIONS LLC, Detroit, MI (US)

(72) Inventors: Jeff Jocsak, Lake Orion, MI (US); John B. Davis, Hartland, MI (US); Haralabos Triantafyllidis, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 211 days.

(21) Appl. No.: 14/997,848

(22) Filed: Jan. 18, 2016

(65) Prior Publication Data

US 2017/0204754 A1 Jul. 20, 2017

(51) Int. Cl.

| | |
|---|---|
| ***F01M 13/00*** | (2006.01) |
| ***F01M 1/04*** | (2006.01) |
| ***F01M 11/00*** | (2006.01) |
| ***F01M 13/04*** | (2006.01) |

(52) U.S. Cl.
CPC ..... *F01M 11/0004* (2013.01); *F01M 13/04* (2013.01); *F01M 2011/0066* (2013.01); *F01M 2013/0488* (2013.01)

(58) Field of Classification Search
CPC ..... F01M 13/00; F01M 13/021; F01M 13/02; F01M 11/0004; F01M 13/04; F01M 2011/0066; F01M 2013/0488; F01M 1/04; F01M 1/16; F01M 11/02; F02B 2075/027; F02B 2075/025
USPC ..... 123/41.86, 196 CP
See application file for complete search history.

(56) References Cited

U.S. PATENT DOCUMENTS

| | | | | |
|---|---|---|---|---|
| 6,520,293 | B1 * | 2/2003 | Ogawa | F16H 57/0434 184/6.22 |
| 2003/0019484 | A1 * | 1/2003 | Lepp | F01M 13/04 123/572 |
| 2008/0011264 | A1 * | 1/2008 | Kawamura | F01M 13/0416 123/196 R |

* cited by examiner

*Primary Examiner* — Syed O Hasan
(74) *Attorney, Agent, or Firm* — Quinn IP Law

(57) ABSTRACT

An oil pan includes a pan structure forming a primary reservoir, and defining a PCV passage, and a PCV reservoir. The PCV passage includes an inlet for receiving fluid from a PCV drain of an engine block, and an outlet disposed vertically below the inlet of the PCV passage for discharging the fluid received from the PCV drain. The PCV reservoir includes a lower end disposed adjacent the outlet of the PCV passage, and an upper end disposed vertically above the lower end of the PCV reservoir and in fluid communication with the primary reservoir. The PCV passage and the PCV reservoir define a fluid flow path forming a fluid trap at the intersection of the outlet of the PCV passage and the lower end of the PCV reservoir, to keep the outlet of the PCV passage submerged during dynamic operation of the engine.

17 Claims, 3 Drawing Sheets

OIL PAN WITH DEDICATED DRAIN FOR POSITIVE CRANKCASE VENTILATION

TECHNICAL FIELD

The disclosure generally relates to an oil pan for an engine, and more specifically to an oil pan having a dedicated drain passage for draining oil from a PCV oil/gas separator back to the oil pan.

BACKGROUND

Blowby gasses are combustion gasses that leak from an engine cylinder past piston rings into the crankcase volume. To prevent the blowby gasses from exiting to the atmosphere, positive crankcase ventilation (PCV) systems transfer blowby gasses from an engine crankcase volume to the engine air intake system, where the blowby gasses are mixed with fresh air and are combusted in the engine cylinders. The blowby gasses include unburned fuel, combustion byproducts, and water vapor. The blowby gasses mix with oil mist in the crankcase. An air/oil separator is sometimes used in the PCV system to separate oil from the blowby gasses en route to the air intake system. The engine includes a PCV drain disposed in fluid communication with the air/oil separator to drain the oil that is separated from blowby gasses into the oil pan. The PCV drain may be formed and/or defined by a cylinder head and/or engine block, depending upon the location of the air/oil separator.

The outlet of the PCV drain should remain submerged in oil within the oil pan. If the outlet of the PCV drain becomes exposed, suction from the PCV system may draw the gasses in the oil pan, including oil mist, in a reverse direction up through the PCV drain, through the air/oil separator, and into the air intake system.

SUMMARY

An oil pan for an engine having a positive crankcase ventilation (PCV) drain is provided. The oil pan includes a pan structure having a bottom wall and a side wall. The side wall extends from the bottom wall, and cooperates with the bottom wall to define a primary reservoir. The pan structure defines a PCV passage, which includes an inlet disposed at a first elevation, and an outlet disposed at a second elevation. The first elevation is higher than the second elevation relative to the bottom wall. The pan structure defines a PCV reservoir, which includes a lower end disposed in fluid communication with the outlet of the PCV passage at the second elevation relative to the bottom wall, and an upper end disposed at a third elevation relative to the bottom wall and in fluid communication with the primary reservoir of the pan structure. The third elevation of the upper end of the PCV reservoir is greater than the second elevation of the lower end of the PCV reservoir and the outlet of the PCV passage. The third elevation of the upper end of the PCV reservoir is less than the first elevation of the inlet of the PCV passage.

An engine is also provided. The engine includes a block defining a Positive Crankcase Ventilation (PCV) drain, and an oil pan attached to the block. The oil pan includes a pan structure forming a primary reservoir, and defining a PCV passage and a PCV reservoir. The PCV passage includes an inlet for receiving fluid from the PCV drain, and an outlet disposed vertically below the inlet of the PCV passage for discharging the fluid received from the PCV drain. The PCV reservoir includes a lower end disposed adjacent the outlet of the PCV passage, and an upper end disposed vertically above the lower end of the PCV reservoir and in fluid communication with the primary reservoir. The PCV passage and the PCV reservoir define a fluid flow path forming a fluid trap at the intersection of the outlet of the PCV passage and the lower end of the PCV reservoir, to keep the outlet of the PCV passage submerged during dynamic operation of the engine.

Accordingly, the PCV reservoir keeps the outlet of the PCV passage submerged beneath engine oil, even when the engine oil in the primary reservoir is shifted within the primary reservoirs, such as may occur during high acceleration maneuvers. The PCV reservoir enables the outlet of the PCV passage to be located anywhere within the primary reservoir. In other words, the outlet of the PCV passage does not have to be located at the lowest elevation of the primary reservoir, because the PCV reservoir ensures that the outlet of the PCV passage stays submerged. This arrangement eliminates the need for costly check valves or extending tubes.

The above features and advantages and other features and advantages of the present teachings are readily apparent from the following detailed description of the best modes for carrying out the teachings when taken in connection with the accompanying drawings.

DETAILED DESCRIPTION

Figure 1:
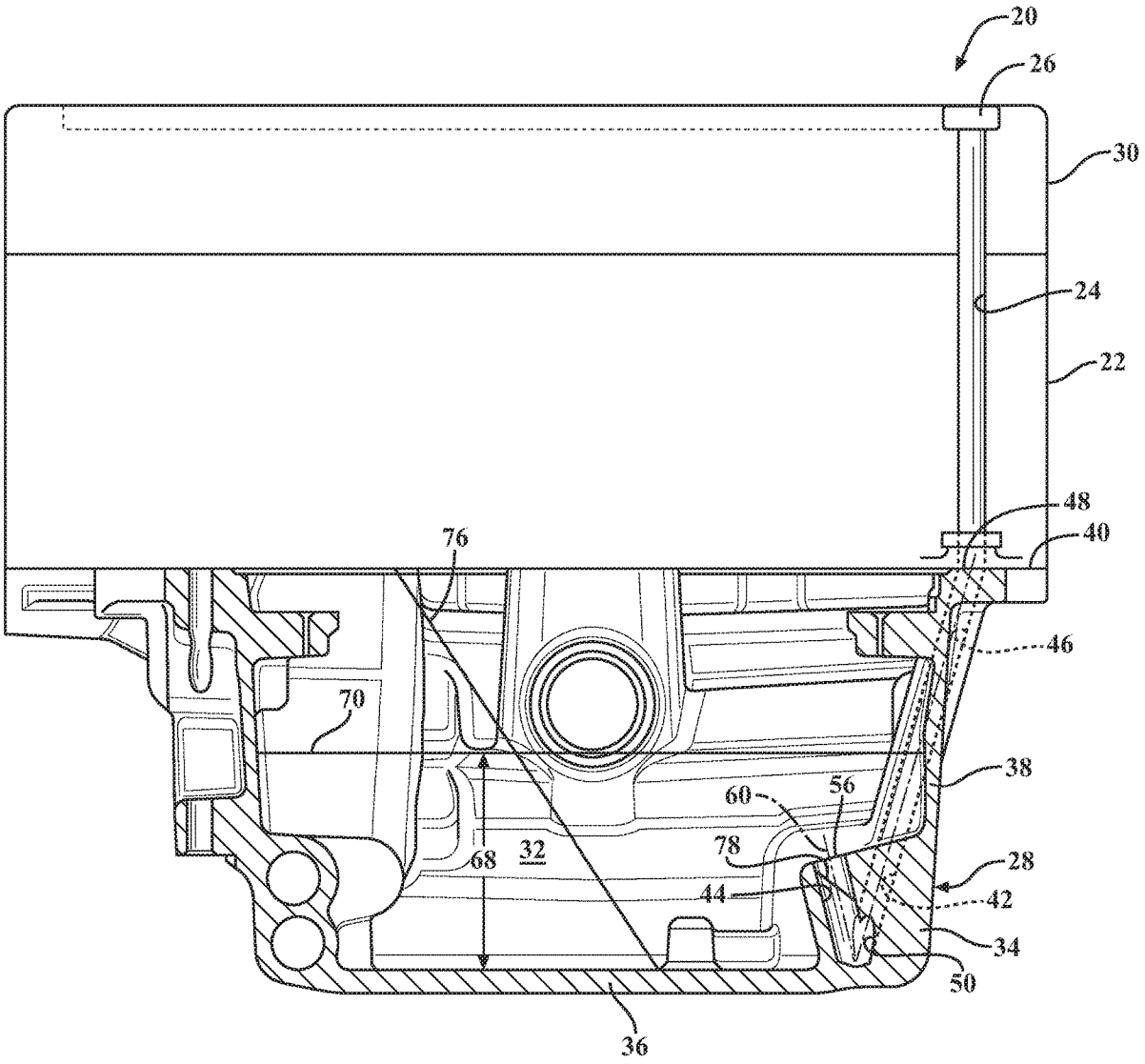
FIG. 1 is a schematic cross section of an engine.
Figure 2:
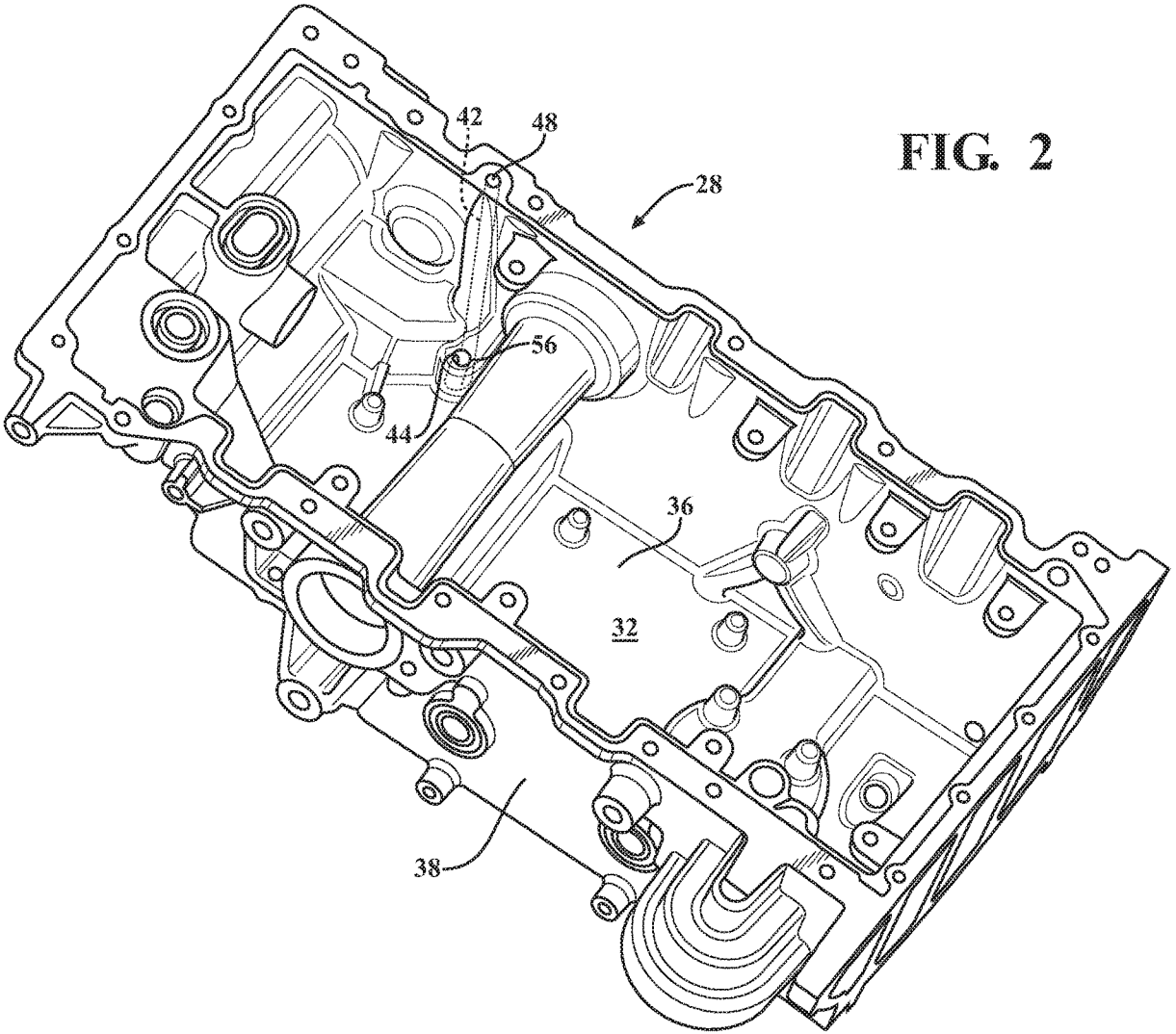
FIG. 2 is a schematic perspective view of an oil pan of the engine.

Those having ordinary skill in the art will recognize that terms such as "above," "below," "upward," "downward," "top," "bottom," etc., are used descriptively for the figures, and do not represent limitations on the scope of the disclosure, as defined by the appended claims.

Referring to the Figures, wherein like numerals indicate like parts throughout the several views, an engine is generally shown at 20. The engine 20 includes a block 22, which defines a Positive Crankcase Ventilation (PCV) drain 24. The PCV drain 24 connects an oil/gas separator 26 to an oil pan 28 for returning a fluid, i.e., engine 20 oil, to the oil pan 28. As is known in the art, the oil/gas separator 26 separates oil from blowby gasses in the crankcase volume of the block 22 prior to the blowby gasses being circulated into the air intake for combustion. The oil that is separated from the blowby gasses in the crankcase volume drains through the PCV drain 24, down into the oil pan 28. The specific configuration of the engine 20, and the exact location and operation of the oil/gas separator 26 are not pertinent to the teachings of this disclosure, and are therefore not described in detail herein. Depending upon the specific configuration of the block 22, the oil/gas separator 26 may be disposed in a cylinder head 30 of the engine 20, in the block 22, or alternatively in some other location. However, it should be appreciated that whatever the configuration of the engine 20, the PCV drain 24 is a dedicated path defined by the block 22, which connects the oil/gas separator 26 with a primary reservoir 32 of the oil pan 28 in fluid communication.

The oil pan 28 is attached to the block 22. The oil pan 28 may be manufactured from any suitable material, such as but not limited to a metal, plastic, nylon, etc. The specific size and/or shape of the oil pan 28 will vary depending upon the specific configuration of the engine 20. However, it should be appreciated that the oil pan 28 includes a pan structure 34, which includes at least a bottom wall 36 and a side wall 38. The side wall 38 extends vertically upward from the bottom wall 36 to an upper edge 40, and cooperates with the bottom wall 36 to define the primary reservoir 32. The oil pan 28 is attached to the block 22 along the upper edge 40 of the side wall 38.

Figure 3:
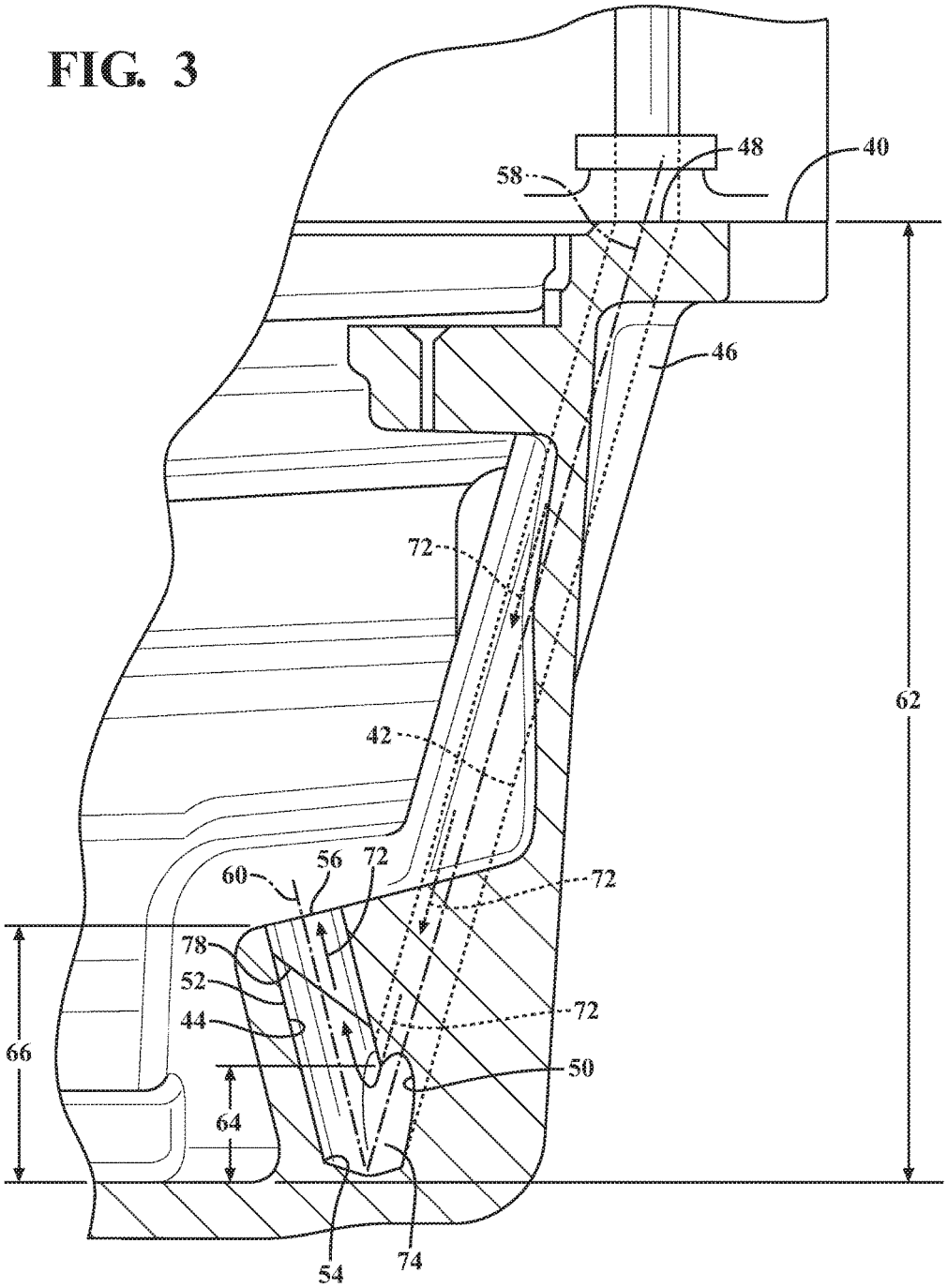
FIG. 3 is a schematic, fragmentary, enlarged cross sectional view of the engine.

As best shown in FIG. 3, the oil pan 28 includes a PCV passage 42, and a PCV reservoir 44. The PCV passage 42 is defined by the pan structure 34. For example, the PCV passage 42 may be defined by a first bore 46 formed into the side wall 38 of the pan structure 34. The PCV passage 42 includes an inlet 48 and an outlet 50. The inlet 48 is disposed adjacent the upper edge 40 of the side wall 38 in fluid communication with the PCV drain 24, for receiving fluid from the PCV drain 24. The outlet 50 is disposed vertically below the inlet 48 of the PCV passage 42 for discharging the fluid received from the PCV drain 24 into the primary reservoir 32. As shown in the exemplary embodiment, the outlet 50 of the PCV passage 42 is disposed substantially adjacent the bottom wall 36 of the pan structure 34. However, it should be appreciated that other embodiments of the oil pan 28 may include the outlet 50 of the PCV passage 42 vertically spaced from the bottom wall 36 of the pan structure 34.

The PCV reservoir 44 is defined by the pan structure 34. For example, the PCV reservoir 44 may be defined by a second bore 52 formed into the side wall 38 of the pan structure 34. Alternatively, it is contemplated that the PCV reservoir 44 may be formed by an interior wall that is positioned within the primary reservoir 32 of the oil pan 28. The PCV reservoir 44 includes a lower end 54 and an upper end 56. The lower end 54 of the PCV reservoir 44 is disposed adjacent the outlet 50 of the PCV passage 42, in fluid communication with the outlet 50 of the PCV passage 42. The upper end 56 of the PCV reservoir 44 is disposed vertically above the lower end 54 of the PCV reservoir 44, in fluid communication with the primary reservoir 32.

As noted above, the PCV passage 42 may be formed and/or defined by the first bore 46, which extends along a first axis 58, and the PCV reservoir 44 may be formed and/or defined by the second bore 52, which extends along a second axis 60. The first axis 58 and the second axis 60 intersect at the intersection of the PCV passage 42 and the PCV reservoir 44. The PCV reservoir 44 extends in a generally vertical direction, relative to the bottom wall 36 of the pan structure 34, between the lower end 54 and the upper end 56 of the PCV reservoir 44. The upper end 56 of the PCV reservoir 44 is disposed between the bottom wall 36 and the upper edge 40 of the side wall 38.

The inlet 48 of the PCV passage 42 is disposed at a first elevation 62. It should be appreciated that the elevation of the inlet 48, i.e., the first elevation 62, is the same elevation as the upper edge 40 of the side wall 38 of the pan structure 34. The outlet 50 of the PCV passage 42 is disposed at a second elevation 64. The intersection of the first axis 58 of the PCV passage 42 and the second axis 60 of the PCV reservoir 44 is disposed at or near the second elevation 64. As described herein, the second elevation 64 is located at the elevation of the outlet 50 of the PCV passage 42 located farthest from the bottom wall 36 of the pan structure 34. Accordingly, the outlet 50 of the PCV passage 42 may extend over a range of elevations relative to the bottom wall 36. However, the second elevation 64 is described herein as the highest elevation of the outlet 50, which is located farthest from the bottom wall 36 of the pan structure 34. Accordingly, it should be appreciated that the second elevation 64 may be offset from the intersection of the first axis 58 and the second axis 60, by a distance related to the size of the outlet 50 of the PCV passage 42 and a size of the lower end 54 of the PCV reservoir 44. The first elevation 62 of the inlet 48 of the PCV passage 42, relative to the bottom wall 36, is higher than the second elevation 64 of the PCV passage 42, relative to the bottom wall 36. Accordingly, the first elevation 62 is greater than the second elevation 64.

The lower end 54 of the PCV reservoir 44 is disposed in fluid communication with the outlet 50 of the PCV passage 42, at the second elevation 64, relative to the bottom wall 36. The upper end 56 of the PCV reservoir 44 is disposed at a third elevation 66 relative to the bottom wall 36. The third elevation 66 of the upper end 56 of the PCV reservoir 44 is greater than the second elevation 64 of the lower end 54 of the PCV reservoir 44 and the outlet 50 of the PCV passage 42. The difference between the third elevation 66 and the second elevation 64 depends on the dynamic maneuvering capability of the vehicle, and the size, shape and/or design of the PCV reservoir 44. The difference between the third elevation 66 and the second elevation 64 should be chosen such that the second elevation 64 is never uncovered from oil during vehicle operation, including maximum vehicle acceleration and/or vehicle inclination, so that air cannot backflow up the PCV drain 48. Accordingly, the difference between the third elevation 66 and the second elevation 64 for a high performance vehicle subject to high accelerations, or an off road vehicle subject to high inclinations, may be much greater than a low performance vehicle. For one exemplary embodiment, the distance between third elevation 66, relative to the bottom wall 36, may be approximately equal to or greater than 20 mm higher than the second elevation 64 of the outlet 50 of the PCV passage 42. However, the distance between the third elevation 66 and the second elevation 64 will vary, depending upon the specific size, design, and/or configuration of the block 22, the oil pan 28, and the PCV reservoir 44. The third elevation 66 of the upper end 56 of the PCV reservoir 44 is less than the first elevation 62 of the inlet 48 of the PCV passage 42. Accordingly, the upper end 56 of the PCV reservoir 44, which is disposed at the third elevation 66, is positioned vertically between the inlet 48 of the PCV passage 42 at the first elevation 62, and the outlet 50 of the PCV passage 42 at the second elevation 64.

The primary reservoir 32 is sized to store a minimum volume of fluid, i.e., engine 20 oil, at a fluid elevation 68 relative to the bottom wall 36 during static operation of the engine 20. As used herein, static operation of the engine 20 refers to engine 20 and/or vehicle operation that does not cause a significant amount of oil slosh or movement within the primary reservoir 32. For example, reference line 70 shown in FIG. 1 indicates fluid elevation 68, i.e., a fluid level, within the primary reservoir 32 during static engine 20 operation. The third elevation 66 of the upper end 56 of the reservoir chamber is less than the fluid elevation 68. Accordingly, during static operating conditions of the engine 20, the PVC reservoir and the outlet 50 of the PCV passage 42 are submerged under the fluid, i.e., engine 20 oil, stored in the primary reservoir 32.

The PCV passage 42 and the PCV reservoir 44 define a fluid flow path 72 for returning engine 20 oil from the oil/gas separator 26 to the primary reservoir 32 of the oil pan 28. The fluid flow path 72 is generally indicated by arrows 72. The fluid flow path 72 forms a fluid trap 74 at the intersection of the outlet 50 of the PCV passage 42 and the lower end 54 of the PCV reservoir 44. As used herein, the term "fluid trap 74" is defined as a device for sealing a passage against the flow of gasses, especially a U-shaped or S-shaped bend in a drain the prevents the return flow of gasses by means of a fluid barrier. The PCV reservoir 44, and particularly the fluid trap 74, are sized to contain fluid, i.e., engine 20 oil, at a depth sufficient to keep the outlet 50 of the PCV passage 42 submerged during dynamic operation of the engine 20. As used herein, dynamic operation of the engine 20 refers to engine 20 and/or vehicle operation that causes oil slosh or movement within the primary reservoir 32. For example, reference line 76 shown in FIG. 1 indicates an oil level within the primary reservoir 32 during dynamic operation of the engine 20. As shown by line 76, the oil within the primary reservoir 32 is moved away from the outlet 50 of the PCV passage 42. However, the oil within the PCV reservoir 44, indicated by reference line 78, keeps the outlet 50 of the PCV passage 42 submerged during the dynamic operating condition.

It is important to keep the outlet 50 of the PCV passage 42 submerged, so that gasses within the primary reservoir 32 are not drawn up through the PCV passage 42, causing them to flow in a reverse direction into the oil/gas separator 26. Keeping the outlet 50 of the PCV passage 42 submerged prevents the backflow of gasses from the primary reservoir 32 of the oil pan 28 to the oil/gas separator 26. The PCV reservoir 44 forms the fluid trap 74 with the PCV passage 42 to ensure that the outlet 50 of the PCV passage 42 remains submerged during all operating conditions of the engine 20.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. An oil pan for an engine having a positive crankcase ventilation (PCV) drain, the oil pan comprising: a pan structure having a bottom wall and a side wall extending from the bottom wall and cooperating with the bottom wall to define a primary reservoir; a PCV passage defined by the pan structure, and including an inlet disposed at a first elevation, and an outlet disposed at a second elevation, wherein the first elevation is higher than the second elevation relative to the bottom wall; a PCV reservoir defined by the pan structure and having a lower end disposed in fluid communication with the outlet of the PCV passage at the second elevation relative to the bottom wall, and an upper end disposed at a third elevation relative to the bottom wall and in fluid communication with the primary reservoir of the pan structure; wherein the pan structure includes a first bore defining the PCV passage and extending along a first axis, and wherein the pan structure includes a second bore defining the PCV reservoir and extending along a second axis, with the first axis and the second axis intersecting each other near the second elevation; wherein the third elevation of the upper end of the PCV reservoir is greater than the second elevation of the lower end of the PCV reservoir and the outlet of the PCV passage; wherein the third elevation of the upper end of the PCV reservoir is less than the first elevation of the inlet of the PCV passage; and wherein the primary reservoir is sized to store a defined volume of fluid at a fluid elevation relative to the bottom wall during static operation of the engine, and wherein the third elevation of the upper end of the reservoir chamber is lower than the fluid elevation during static operation of the engine.

2. The oil pan set forth in claim 1 wherein the side wall of the pan structure extends upward from the bottom wall to an upper edge, with the inlet of the PCV passage disposed adjacent the upper edge of the side wall.

3. The oil pan set forth in claim 2 wherein the upper end of the PCV reservoir is disposed vertically between the bottom wall and the upper edge of the side wall.

4. The oil pan set forth in claim 1 wherein the PCV reservoir extends generally vertically between the lower end and the upper end of the PCV reservoir.

5. The oil pan set forth in claim 1 wherein the side wall of the pan structure defines the PCV passage.

6. The oil pan set forth in claim 1 wherein the side wall of the pan structure defines the PCV reservoir.

7. The oil pan set forth in claim 1 wherein the PCV reservoir is sized to contain fluid at a depth sufficient to keep the outlet of the PCV passage submerged during dynamic operation of the engine.

8. The oil pan set forth in claim 1 wherein the PCV passage and the PCV reservoir define a fluid flow path forming a fluid trap at the intersection of the outlet of the PCV passage and the lower end of the PCV reservoir.

9. The oil pan set forth in claim 1 wherein the third elevation is higher than the second elevation relative to the bottom wall.

10. The oil pan set forth in claim 1 wherein the outlet of the PCV passage is disposed adjacent the bottom wall of the pan structure.

11. The oil pan set forth in claim 1, wherein the upper end of the PCV reservoir is the only outlet of the PCV reservoir.

12. An engine comprising: a block defining a Positive Crankcase Ventilation (PCV) drain; an oil pan attached to the block, the oil pan including: a pan structure forming a primary reservoir, and defining a PCV passage, and a PCV reservoir; wherein the PCV passage includes an inlet for receiving fluid from the PCV drain, and an outlet disposed vertically below the inlet of the PCV passage for discharging the fluid received from the PCV drain; wherein the PCV reservoir includes a lower end disposed adjacent the outlet of the PCV passage, and an upper end disposed vertically above the lower end of the PCV reservoir and in fluid communication with the primary reservoir; wherein the PCV passage and the PCV reservoir define a fluid flow path forming a fluid trap at the intersection of the outlet of the PCV passage and the lower end of the PCV reservoir, to keep the outlet of the PCV passage submerged during dynamic operation of the engine; wherein the pan structure includes a first bore defining the PCV passage and extending along a first axis, and wherein the pan structure includes a second bore defining the PCV reservoir and extending along a second axis, with the first axis and the second axis intersecting each other near the fluid trap; wherein the pan structure includes a bottom wall and a side wall extending upward from the bottom wall to an upper edge to define the primary reservoir; the inlet of the PCV passage is disposed at a first elevation, and the outlet of the PCV passage is disposed at a second elevation, wherein the upper end of the PCV reservoir is disposed at a third elevation relative to the bottom wall; and wherein the primary reservoir is sized to store a defined volume of fluid at a fluid elevation relative to the bottom wall during static operation of the engine, and wherein the third elevation of the upper end of the reservoir chamber is lower than the fluid elevation during static operation of the engine.

13. The engine set forth in claim 12 wherein: the first elevation is higher than the second elevation relative to the bottom wall; the lower end of the PCV reservoir is disposed at the second elevation relative to the bottom wall; and wherein the third elevation is greater than the second elevation relative to the bottom wall, and is less than the first elevation relative to the bottom wall.

14. The engine set forth in claim 12 wherein the PCV reservoir is sized to contain fluid at a depth sufficient to keep the outlet of the PCV passage submerged during dynamic operation of the engine.

15. The engine set forth in claim 13 wherein the third elevation is higher than the second elevation relative to the bottom wall.

16. The engine set forth in claim 13 wherein the outlet of the PCV passage is disposed adjacent the bottom wall of the pan structure.

17. The engine set forth in claim 12, wherein the upper end of the PCV reservoir is the only outlet of the PCV reservoir.

* * * * *